US011045679B2

(12) United States Patent
Bolillo

(10) Patent No.: US 11,045,679 B2
(45) Date of Patent: Jun. 29, 2021

(54) VERSATILE BALANCE AND EXERCISE APPARATUS AND METHODS

(71) Applicant: Mathieu Bolillo, Las Vegas, NV (US)

(72) Inventor: Mathieu Bolillo, Las Vegas, NV (US)

( * ) Notice: Subject to any disclaimer, the term of this patent is extended or adjusted under 35 U.S.C. 154(b) by 50 days.

(21) Appl. No.: 16/411,121

(22) Filed: May 13, 2019

(65) Prior Publication Data

US 2019/0262650 A1 Aug. 29, 2019

Related U.S. Application Data

(63) Continuation-in-part of application No. 29/580,854, filed on Oct. 13, 2016, now Pat. No. Des. 848,556.

(51) Int. Cl.

| | |
|---|---|
| ***A63B 17/02*** | (2006.01) |
| ***A63B 21/00*** | (2006.01) |
| ***A63B 26/00*** | (2006.01) |
| ***A63B 23/00*** | (2006.01) |

(52) U.S. Cl.

CPC ..... *A63B 17/02* (2013.01); *A63B 21/00047* (2013.01); *A63B 21/00178* (2013.01); *A63B 26/003* (2013.01); *A63B 2023/006* (2013.01); *A63B 2225/09* (2013.01)

(58) Field of Classification Search

CPC ..... A63B 3/00; A63B 9/00; A63B 2009/006; A63B 17/00; A63B 17/02; A63B 17/04; A63B 21/00047; A63B 21/0005; A63B 21/00054; A63B 21/00178; A63B 21/00185; A63B 21/068; A63B 21/4027; A63B 21/4033; A63B 21/4035; A63B 23/02; A63B 23/0205; A63B 23/0211; A63B 23/0216; A63B 23/0222; A63B 23/04; A63B 23/0482; A63B 23/0494; A63B 23/12; A63B 23/1209; A63B 23/1227; A63B 23/1236; A63B 23/1245; A63B 23/1281; A63B 2023/006; A63B 26/00; A63B 26/003; A63B 2208/0204; A63B 2208/0209; A63B 2208/0242; A63B 2208/0252; A63B 2208/0295; A63B 2208/12; A63B 2209/00; A63B 2225/10

See application file for complete search history.

(56) References Cited

U.S. PATENT DOCUMENTS

| | | | | |
|---|---|---|---|---|
| 99,718 A * | 2/1870 | Sherwood | ..... | A47G 19/30 211/85.4 |
| 2,666,640 A | 1/1954 | Jennings | | |
| 3,016,267 A | 1/1962 | Cones | | |

(Continued)

*Primary Examiner* — Gary D Urbiel Goldner
(74) *Attorney, Agent, or Firm* — Connie R. Masters

(57) ABSTRACT

A versatile exercise apparatus includes a central foundation frame and two arched bars. The frame comprises two generally parallel lateral cross bars, two generally parallel longitudinal bars, and two partial circular bars attached to four 4-way joints. The two arched bars are also attached at the four 4-way joints and extend perpendicularly from the frame. In some aspects of the invention, the frame elements and two arched bars are attachable and detachable, allowing the formation of two modules. In this aspect the modules may be attached in corresponding or opposing orientations. This permits manual modification of the exercise device, thereby increasing the number of exercises, balance techniques, and stretches that can be performed with the exercise apparatus.

13 Claims, 14 Drawing Sheets

(56) References Cited

U.S. PATENT DOCUMENTS 3,044,773 A * 7/1962 Cox ..... A63G 13/02 472/114
D210,469 S 3/1968 Sejersen
3,475,020 A * 10/1969 Schauerte ..... A63B 22/16 482/146
D267,419 S 12/1982 Komarnicki
4,826,151 A 5/1989 Nuredin
D309,365 S * 7/1990 Keene ..... D1/105
D327,606 S * 7/1992 Oellig ..... D6/678.4
5,269,527 A * 12/1993 Noval ..... A63B 71/022 473/197
5,649,867 A * 7/1997 Briggs ..... A63B 9/00 472/128
D387,949 S * 12/1997 Bentson ..... 99/426
5,820,472 A * 10/1998 Briggs ..... A63B 9/00 472/128
6,165,112 A * 12/2000 Morris ..... A63B 21/0552 482/129
6,196,951 B1 * 3/2001 Shepherd ..... A63B 21/072 482/106
D451,345 S * 12/2001 Tiemann ..... D7/409
6,823,773 B2 * 11/2004 Swinford ..... A47J 37/0694 99/426
D519,586 S 4/2006 Schulz et al.
D536,753 S 2/2007 Rongo
D542,092 S * 5/2007 Raichlen ..... D7/409
D566,800 S 4/2008 St. Jules
D580,998 S 11/2008 Lin
7,476,187 B2 1/2009 Corte
D593,169 S 5/2009 Storch
7,651,449 B1 * 1/2010 Balentine ..... A63B 23/12 482/95
7,713,182 B2 * 5/2010 Bizzell ..... A63B 23/0458 482/142
D662,997 S 7/2012 Su
D675,686 S 2/2013 Maki
D686,287 S 7/2013 Boatwright
D691,220 S 10/2013 Calvin
D701,581 S 3/2014 Heitzman
D703,773 S 4/2014 Henry
D704,779 S 5/2014 Boatwright
D712,987 S 9/2014 Salzedo et al.
9,192,804 B2 * 11/2015 Inglut ..... A63B 23/1227
9,511,252 B1 * 12/2016 Ho ..... A63B 21/4039
D795,970 S 8/2017 McMaster
D848,556 S * 5/2019 Bolillo ..... A63B 21/00178 D21/691
2004/0224823 A1 * 11/2004 Myers ..... A63B 6/00 482/35
2005/0101461 A1 5/2005 Johnson
2005/0164848 A1 * 7/2005 Carbone ..... A63B 22/0076 482/92
2005/0209054 A1 9/2005 Lebert
2006/0199709 A1 * 9/2006 Shepherd ..... A63B 23/1281 482/109
2009/0124471 A1 5/2009 Storch
2010/0152007 A1 * 6/2010 Le ..... A63B 26/003 482/148
2011/0124476 A1 * 5/2011 Holley ..... A63B 23/02 482/121
2012/0046150 A1 * 2/2012 Stacey ..... A63B 21/00047 482/131
2012/0277075 A1 * 11/2012 Ho ..... A63B 23/03541 482/141
2012/0316038 A1 * 12/2012 Beckwith ..... A63G 21/00 482/35
2013/0324371 A1 * 12/2013 Cayo ..... A63B 21/15 482/87
2013/0337982 A1 * 12/2013 Williams ..... A63B 21/151 482/122
2014/0135183 A1 * 5/2014 Inglut ..... A63B 23/1281 482/96
2014/0200123 A1 7/2014 Placide
2014/0371040 A1 12/2014 Vasquez et al.
2016/0074693 A1 3/2016 Henry
2016/0082313 A1 * 3/2016 MacColl ..... A63B 23/0233 482/140

* cited by examiner

VERSATILE BALANCE AND EXERCISE APPARATUS AND METHODS

CROSS-REFERENCE TO RELATED APPLICATIONS

The present nonprovisional application is a continuation-in-part of U.S. Design patent application Ser. No. 29/580,854 that was filed on Oct. 13, 2016 (now U.S. Design Pat. No. D848556), which is incorporated herein in its entirety.

FIELD OF INVENTION

This invention relates generally to a balance and exercise apparatus, and, more particularly, to a fitness device for physical training, balance development, and stretching of multiple muscle groups.

BACKGROUND OF THE INVENTION

A variety of exercise devices are available that enable a user to exercise or stretch one part of the body or to train for a particular sport. Many of the available exercise devices are limited to a particular muscle group or to a single type of exercise. Some of these are exercise devices that enable pushup exercises to exercise the chest muscles. Others are sit up-type exercise devices to develop the muscles of the abdomen. Some exercise devices strengthen the core muscles. Additionally, there are sport-specific exercise devices that strengthen a particular set of muscles needed in the specific sport. Other exercise devices allow the user to practice movements that develop balance. These include various types of balance beams and balance balls. Some exercise devices enable the user to perform stretches.

Though exercise systems have been developed that exercise multiple muscle groups, these tend to be bulky, complex, expensive, and not transportable.

Thus, though there are exercise devices that are focused on one muscle group or a few muscle groups, on one sport, on stretching exercises, or on improving balance, there is a need for a versatile exercise device that consolidates all of these aspects into a single apparatus that is not complex, not expensive, not bulky, and is transportable while enabling a wide variety of exercises, stretches, and balance training.

BRIEF SUMMARY OF THE INVENTION

The present invention is directed to a versatile exercise apparatus that includes a central foundation frame that is generally planar with two attached arched bars and with each of the arched bars extending substantially perpendicularly from the foundation frame.

The central foundation frame comprises two generally parallel lateral cross bars, two generally parallel longitudinal bars, four 4-way joints, and two partial circular bars. End portions of the two lateral cross bars, two parallel longitudinal bars, and two partial circular bars are attached to one of the 4-way joints. Each end of each of the two arched bars is also attached to one of the 4-way joints.

In one aspect the exercise apparatus includes a first module that is attachable to, and detachable from, a second module by the two longitudinal bars. Each module comprises a lateral cross bar, two four 4-way joints, one partial circular bar, and one arched bar.

In a first configuration, the first and second module are arranged in a corresponding orientation with the arched bar of each module oriented in the same or corresponding direction. In a second configuration, the first and second module are arranged in an opposing orientation with the arched bar of each module oriented in opposite or opposing directions.

In both configurations, the two partial circular bars, the two lateral cross bars, the four 4-way joints, and the two longitudinal bars joining the two modules form a center foundation frame. In the corresponding configuration, the arched bars of the two modules extend outwardly from the central foundation frame in the same direction. In the opposing configuration, the first arched bar of the first module extends outwardly perpendicularly from the central foundation in a first direction. The second module is rotated 180 degrees from its orientation in the first corresponding configuration, so the second arched bar extends outwardly and perpendicularly in an opposite direction.

The versatile exercise apparatus may be utilized for a variety of stretching and physical training exercises, because it provides multiple levels, angles, and bridges that may be used to train various parts of the body. Additionally, it may be used in either the corresponding or opposing configuration, which provide variations in the placement of the levels, angles, and bridges. Further, a single module may be disconnected from the remainder of the exercise apparatus leaving a subset array that may be used alone in a stable orientation and a rocking orientation to provide yet greater variety in exercises and stretches.

Additionally, the incorporation of two rounded elements in each module, the arched bar and the partial circular bar, provide multiple opportunities for balance training and maneuvers.

In one embodiment, the exercise apparatus is formed unitarily. In another embodiment, some of the elements are separable. In the separable embodiment, the exercise apparatus may be stored and transported more easily, and a portion of the exercise apparatus, a subset array, may be used as a supplemental exercise apparatus that is formed by the removal of one module from the full exercise apparatus.

In one aspect of the invention, the exercise apparatus is formed into a unitary device and is not separable.

In a further aspect of the invention, the exercise apparatus is formed of multiple separable elements.

In an additional aspect of the invention, the exercise apparatus is separable and is assembled into a first configuration with the arched bars oriented in the same direction.

In another aspect of the invention, the separable exercise apparatus is separable and assembled into a second configuration with the arched bars oriented in opposing directions.

In a further aspect of the invention, a first module is separated from the remainder of the separable exercise apparatus to create a subset array (the second module and the longitudinal bars) that is used alone.

In another aspect of the invention, a set of extenders is used to lengthen the longitudinal side bars of the separable aspect of the exercise apparatus.

In an additional aspect of the invention, a set of extenders is used to extend one arched bar or both arched bars a greater distance from the central foundation.

In a further aspect of the invention, the arched bars are partially or fully covered with a non-slip material.

In another aspect of the invention, at least four feet are attached on the bottom of the central foundation frame to reduce slippage of the exercise apparatus.

The object of the invention is to provide an exercise apparatus and methods which give an improved performance over the above described prior art apparatuses and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
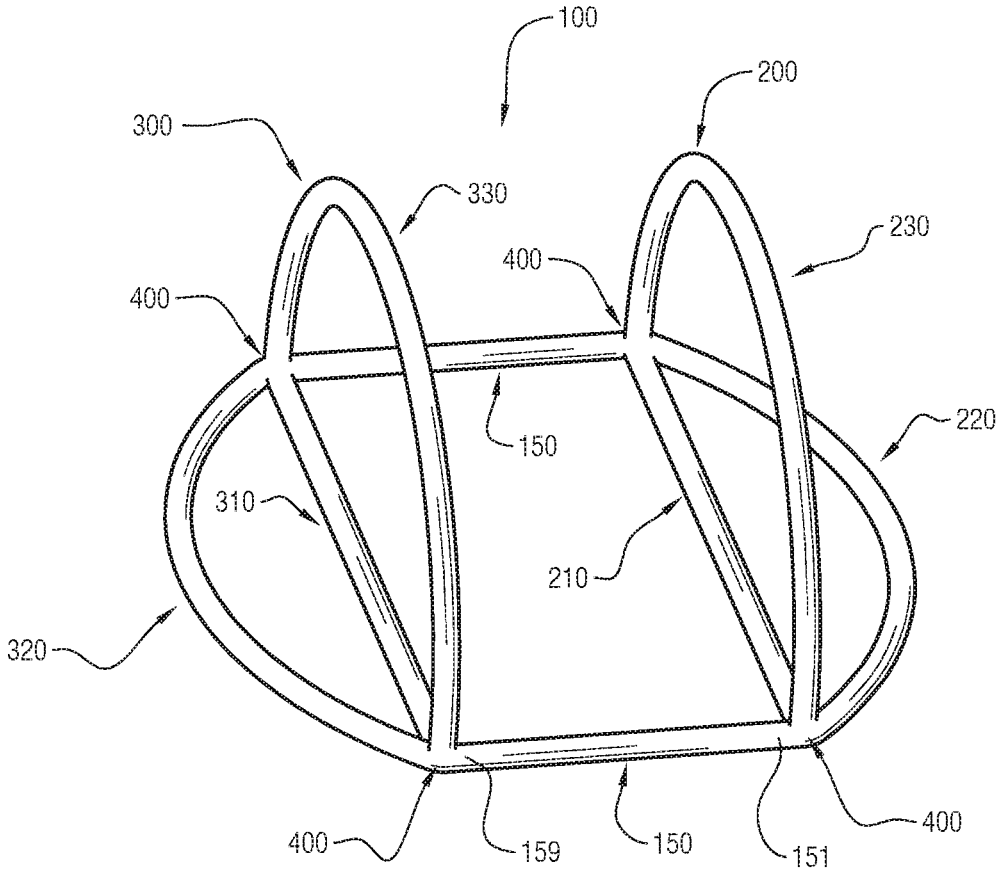
FIG. 1 is a perspective view of an embodiment of the present invention in a corresponding orientation.
Figure 2:
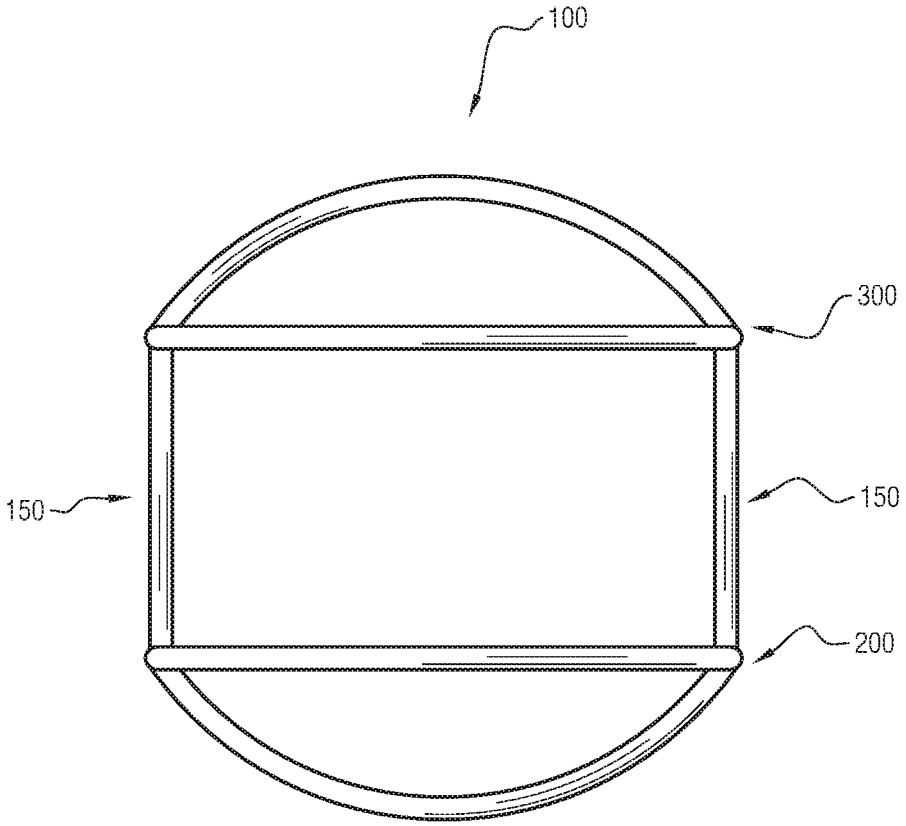
FIG. 2 is a top view of an embodiment of the present invention.
Figure 3:
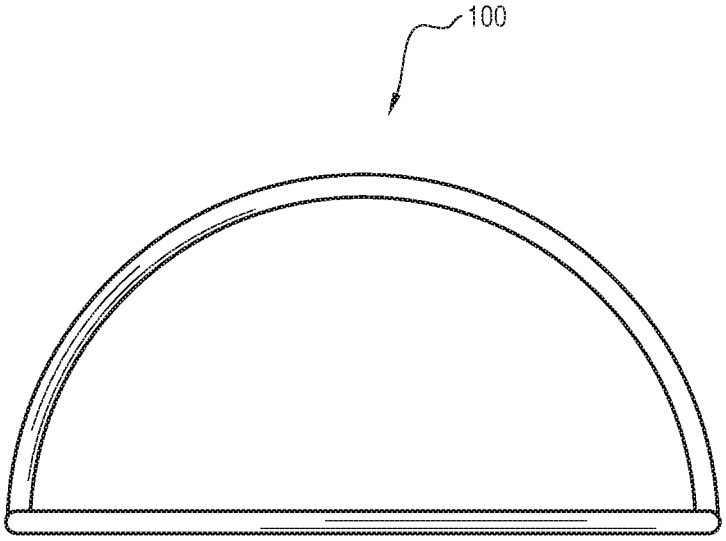
FIG. 3 is a side view of an embodiment of the present invention.
Figure 4:
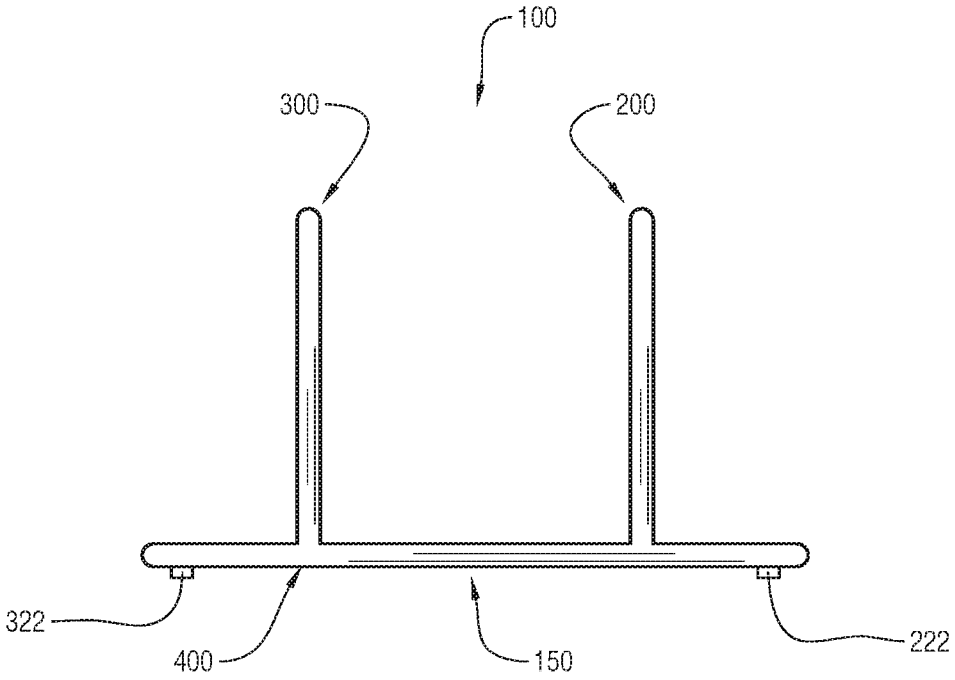
FIG. 4 is a front view of an embodiment of the present invention.

Shown throughout the figures, the present invention is directed toward a versatile balance and exercise apparatus and methods of assembly, conversion, and use. The versatile balance and exercise apparatus is an array of bars particularly designed to enable a user to enhance balancing skills and to perform a wide range of movements to increase general fitness, for core strengthening, to strengthen various muscle groups, to stretch, to improve balance, and to generally improve the physical condition of the user. In some aspects of the invention, a single fitness apparatus may be converted into multiple configurations that are usable for different exercises and stretches, thus increasing the value and versatility of the fitness apparatus.

In the first embodiment, the elements of the fitness apparatus are fixedly joined together. Therefore, the fitness apparatus of the first embodiment is not separable or collapsible. In the second embodiment, some of the elements of the fitness apparatus are attachable and detachable from other elements of the fitness apparatus, which enables convenient transport and/or storage of the fitness apparatus as well as the modification of the fitness apparatus to create multiple orientations to enable different exercises and drills.

Referring now to FIGS. 1-4, a versatile balance and exercise apparatus, shown generally as reference number 100, is illustrated in accordance with a first embodiment of the present invention. As shown, the versatile balance and exercise apparatus 100 comprises a first module 200, a second module 300, four 4-way joints, and two longitudinal, generally parallel longitudinal bars 150 that serve to connect the two modules 200, 300.

Each of the first and second modules 200, 300 comprises a lateral cross bar 210, 310, a partial circular bar 220, 320, two 4-way joints 400, and an arched bar 230, 330, respectively. In the first module, the lateral cross bar 210 is attached between first and second 4-way joints 400, the partial circular bar 220 is attached between the first and second 4-way joints 400, and the arched bar 230 is attached between the first and second 4-way joints 400. In the second module, the lateral cross bar 310 is attached between the third and fourth 4-way joints 400, the partial circular bar 320 is attached between the between third and fourth 4-way joints 400, and the arched bar 330 is attached between the third and fourth 4-way joints 400. The first joint 400 is attached to a first end 151 of a first longitudinal bar 150, with the opposing second end 159 of the first longitudinal bar 150 attached to the third joint 400. The second joint 400 is attached to a first end 151 of a second longitudinal bar 150, with the opposing second end 159 of the second longitudinal bar 150 attached to the fourth joint 400.

In the first embodiment, the versatile balance and exercise apparatus 100 is not separable. The bars 210, 220, 230, 310, 320, 330, 150 are fixedly attached to the four 4-way joints 400, or, alternatively, the joints and bars may be formed unitarily. This creates a single composite structure that is not collapsible and that cannot be broken down to create a more compact structure for storage.

The first embodiment of FIGS. 1-4 also illustrates the corresponding configuration in which both arched bars 230, 330 are disposed on the same side of the versatile balance and exercise apparatus 100. Optionally, the non-separable versatile balance and exercise apparatus 100 may be manufactured in an opposing configuration (the configuration seen in FIGS. 7-9) in which one arched bar 230 is disposed on one side of the versatile balance and exercise apparatus 100 and the other arched bar 330 is disposed on the opposite side of the versatile balance and exercise apparatus 100. In one aspect, four (or more) somewhat malleable feet 222, 322 may be disposed on the bottoms of the versatile balance and exercise apparatus 100, such as on the bottom of partial circular bars 220, 320, on the bottom of the joints 400, or on the bottom of the longitudinal bars 150. These may reduce slippage and provide stability for use in some environments. In another aspect, a non-slip material 227, 327 (FIG. 7) may be applied to the arched bars 230, 330 to aid in gripping and to reduce slippage of the user's hands. This non-slip material may be adhesively attached to the bars, may be sprayed onto the bars, or otherwise fixedly attached.

In FIGS. 5-14 the versatile balance and exercise apparatus 100 is illustrated in accordance with a second preferred embodiment of the present invention. As in the first embodiment, the versatile balance and exercise apparatus 100 comprises a first module 200, a second module 300, and two generally parallel longitudinal bars 150 that serve to connect the two modules 200, 300 in either the corresponding or opposing configuration. But the second embodiment differs in that at least one of the bars attached to each of the four 4-way joints is detachable and re-attachable. In one aspect only the arched bars 230, 330 are detachable from the 4-way joints 400. In another aspect, only the longitudinal bars 150 are detachable from the 4-way joints 400. Preferably, both the arched bars 230, 330 and the longitudinal bars 150 are detachable from the 4-way joints 400, as shown.

Figure 5:
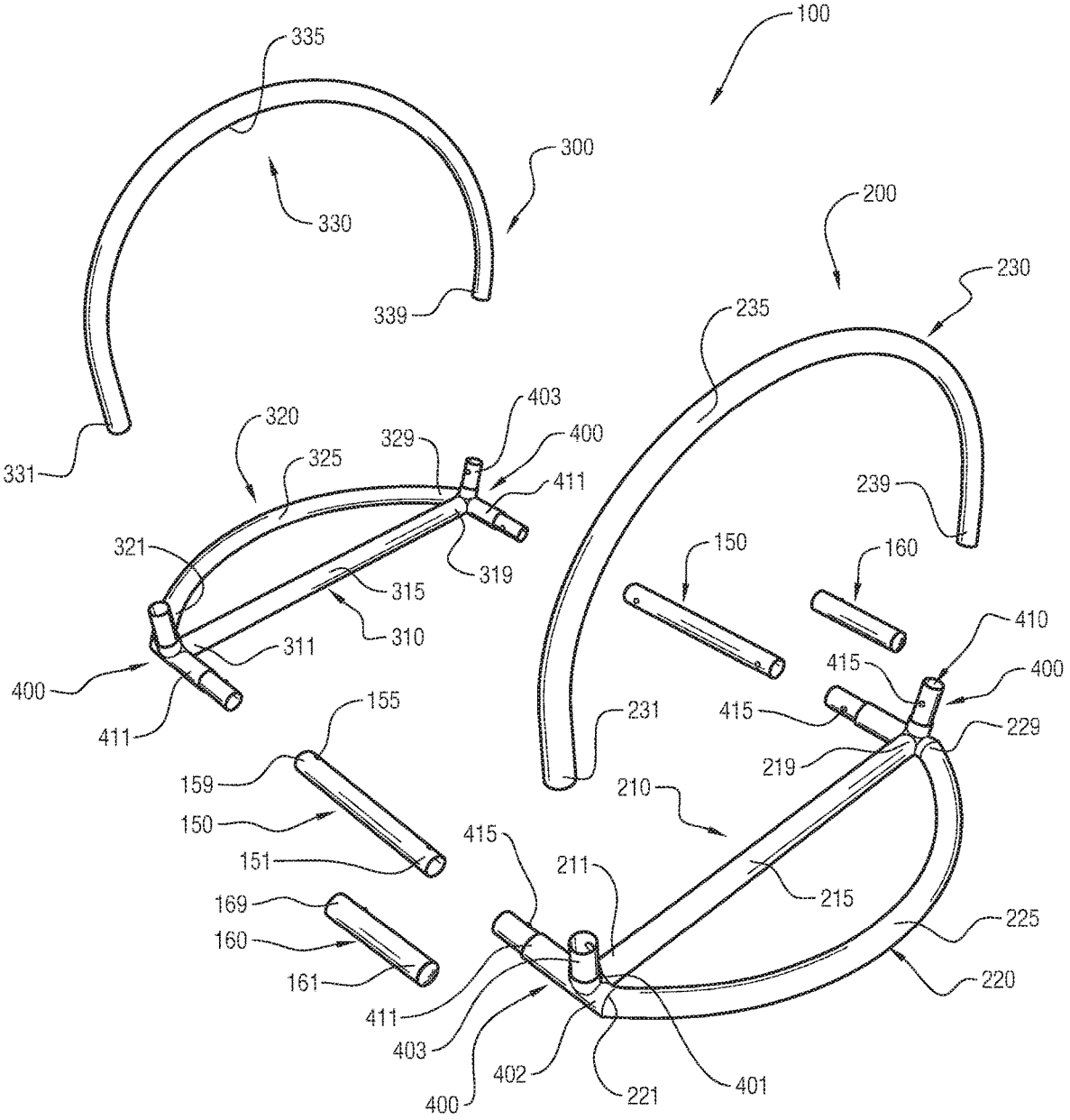
FIG. 5 is a partially exploded view of an embodiment of the present invention.

Turning to the partially expanded view of FIG. 5, the longitudinal bars 150 each extend from a first end portion 151 to an opposing second end portion 159. In the first module 200, the lateral cross bar 210 extends between a first end portion 211 and an opposing second end portion 219. The partial circular bar 220 extends between a first end portion 221 and an opposing second end portion 229. The arched bar 230 extends between a first end portion 231 and an opposing second end portion 239. Similarly, in the second module 300, the lateral cross bar 310 extends between a first end portion 311 and an opposing second end portion 319. The partial circular bar 320 extends between a first end portion 321 and an opposing second end portion 329. The arched bar 330 extends between a first end portion 331 and an opposing second end portion 339. Both arched bars 230, 330 have a curved or arched middle portion 235, 335. At least a portion of the curved middle portion 235, 335 may substantially follow the curve of a circle. The curved middle portions 235, 335 may smoothly attach to generally straight end portions 231, 331, 239, 339 with the straight end portions 231, 331, 239, 339 connectable to one of the joint 400 projections.

Figure 6:
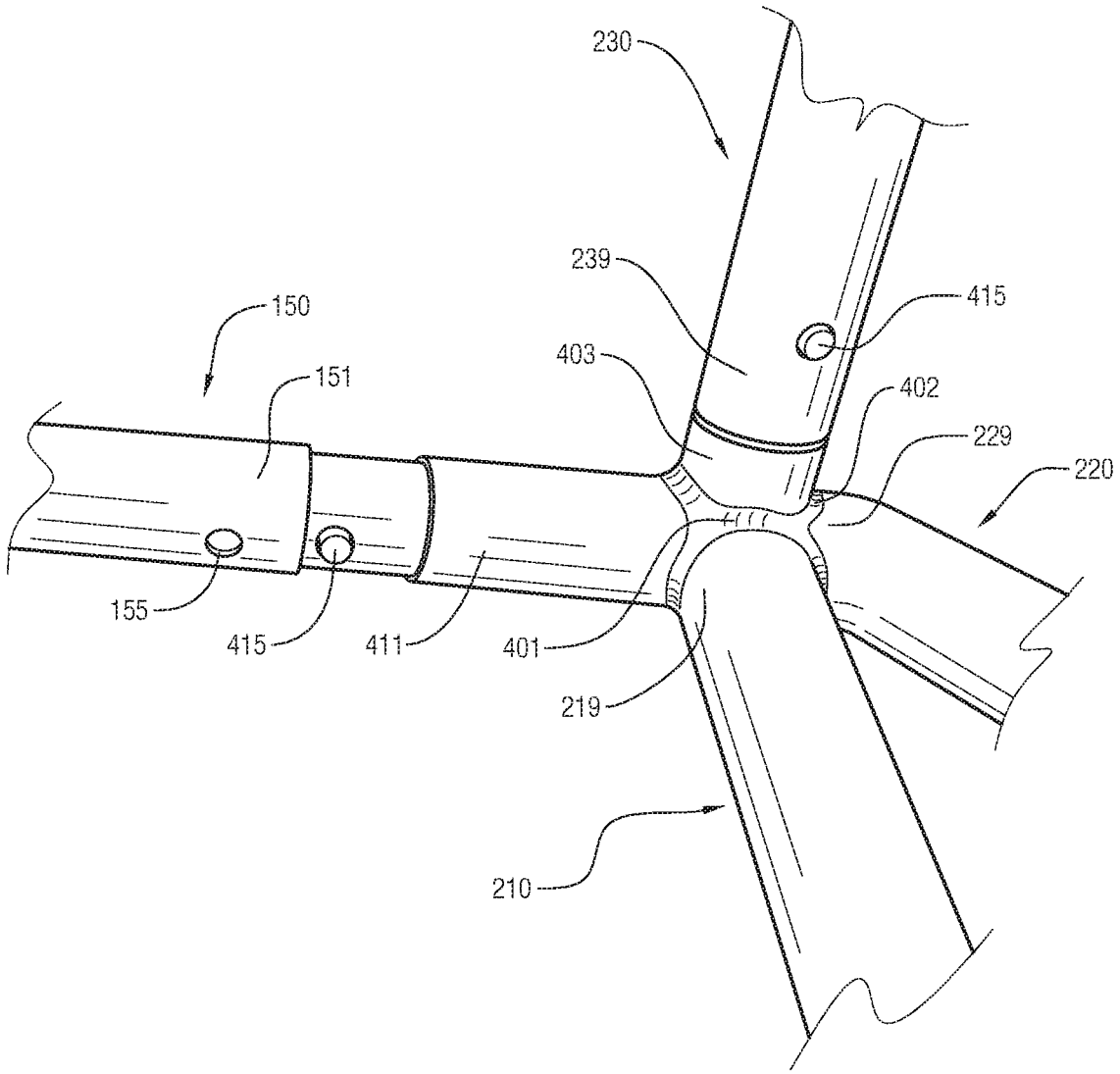
FIG. 6 is a perspective detail view of one of the four 4-way joints of an embodiment of the present invention.

The 4-way joint 400, best seen in FIG. 6, has a first portion 401, a second portion 402, a third portion 403, and a fourth portion 411. When positioned in the corresponding configuration (FIG. 5) or in the opposing configuration (FIG. 7), the joints 400 are positioned at the corners of a rectangle formed by the longitudinal bars 150 and the two lateral cross bars 210, 310. In the separable aspects of the invention, at least one movable locking mechanism (shown as retractable buttons 415 that engage with receiving holes defined by receiving hole edges 155, FIG. 7) is disposed at the first portion 401, second portion 402, third portion 403, or the fourth portion 411 of each joint 400.

The two longitudinal bars 150 connect between the fourth portions 411 of the four 4-way joints 400. The opposing end portions of the lateral cross bars 210, 310 of the two modules connect between the first portions 401 of the four 4-way joints 400. The opposing end portions of the partial circular bars 220, 320 of the two modules connect between the second portions 402 of the four 4-way joints 400. The opposing end portions of the arched bar 230, 330 of the two modules connect between the third portions 403 of the four 4-way joints 400.

In both the corresponding and opposing configurations, an inner rectangular shape is formed with the two longitudinal bars 150 and the two lateral cross bars 210, 310 forming the edges of the rectangle and with the joints 400 disposed at the vertices of the rectangle. Each vertex is generally ninety degrees. The partial circular bars 220, 320 attach adjacent the lateral cross bars 210, 310 to form a curved portion outside the inner rectangle shape. Each vertex is generally ninety degrees.

In both the corresponding and opposing configurations, a central foundation of is formed that includes both the inner rectangular shape and the two partial circular bars 220, 320. The inner rectangular shape and the partial circular bars 220, 320 are disposed generally within a plane. Thus, the central foundation is a central frame that includes the two lateral cross bars 210, 310, the two longitudinal bars 150, the two partial circular bars 220, 320, and the four 4-way joints 400.

Turning to FIG. 5, which will be used as a reference for the "top" and "bottom" designations, the top of each of the two lateral cross bars 210, 310, the two longitudinal bars 150, the two partial circular bars 220, 320, and the four 4-way joints 400 are oriented upwardly in FIG. 5. In the corresponding configuration, as shown in FIG. 5, the top of each of the two lateral cross bars 210, 310, the two longitudinal bars 150, the two partial circular bars 220, 320, and the four 4-way joints 400 are oriented upwardly.

In the corresponding configuration, with the user facing forward, the user's hands may be positioned on the top portion of the arched bars 230, 330 to perform handstands, two-handed pushups, one-handed pushups, and other exercises using the user's weight as resistance. With the user facing away from the versatile balance and exercise apparatus 100, the user can perform various triceps and back exercises including dips. The user can also lie on the floor and hook the feet under one of the arched bars 230, 330 to do sit-ups. (The exercise apparatus can be used on any flat surface, but the term "floor" is used for convenience; thus the term includes the ground, yoga mats, carpet, cushioned matting, and other generally flat surfaces.)

Figure 7:
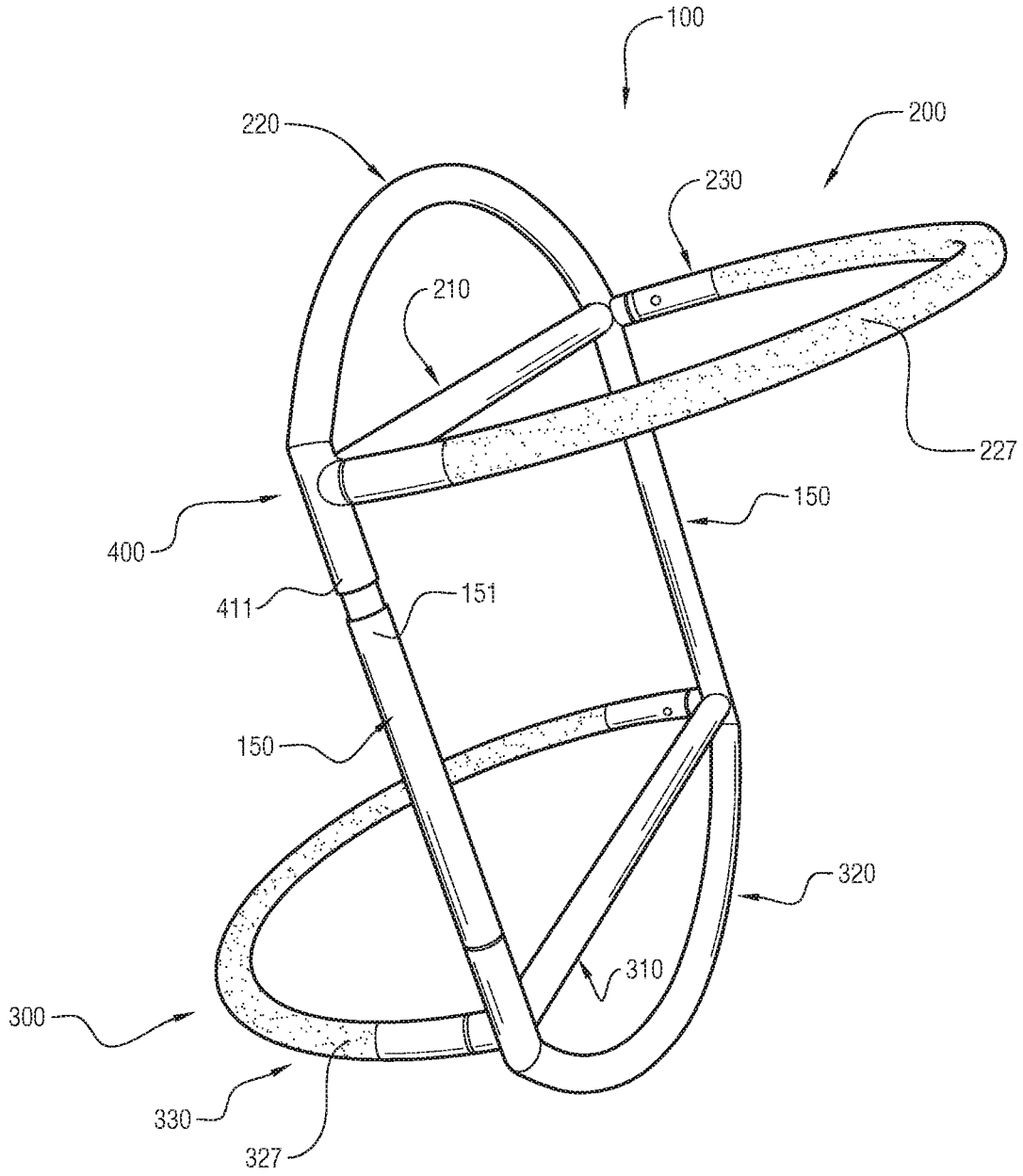
FIG. 7 is a perspective view of an embodiment of the present invention assembled in an opposing configuration.
Figure 8:
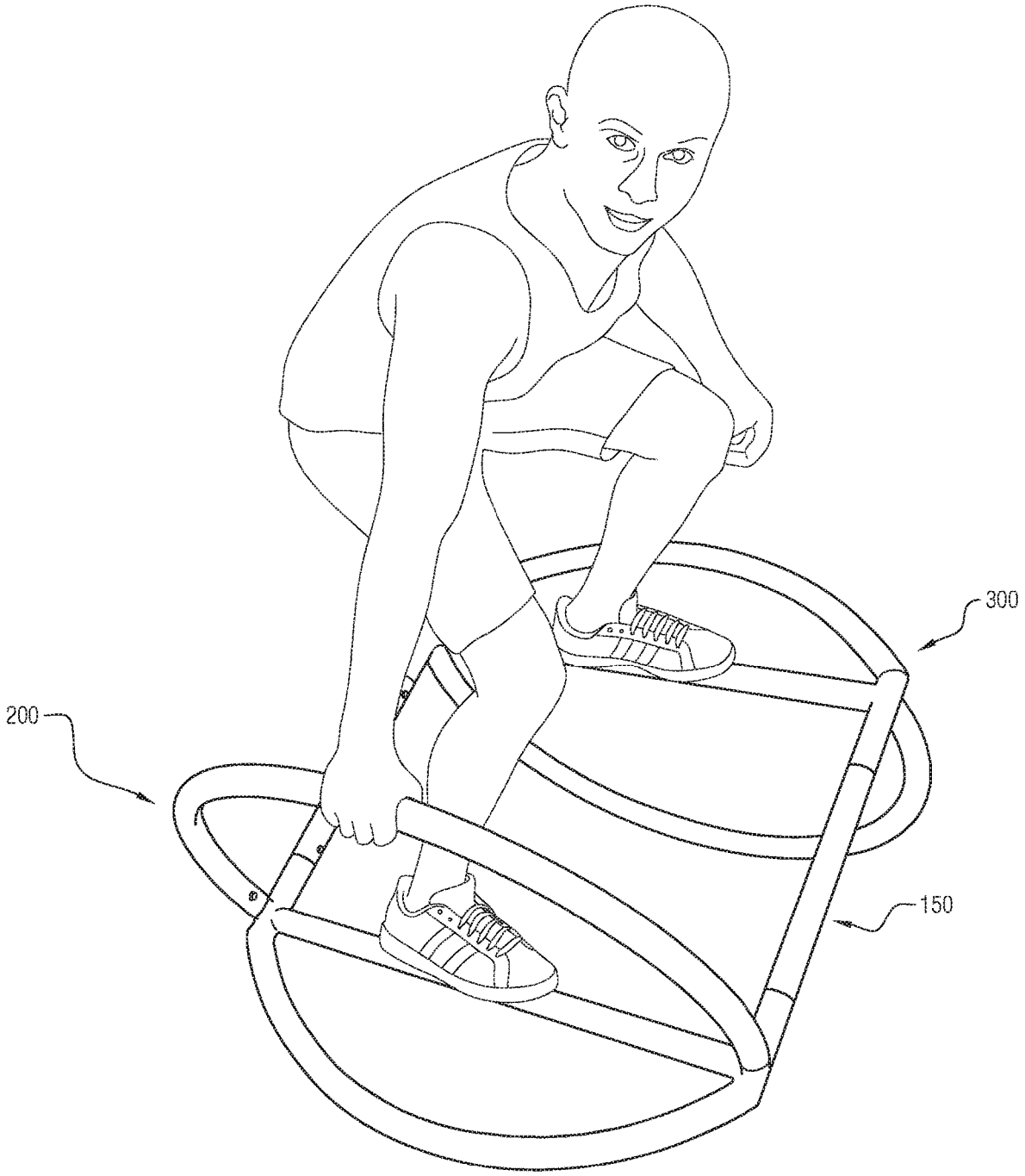
FIG. 8 is a perspective view of an embodiment of the present invention assembled in an opposing configuration.
Figure 9:
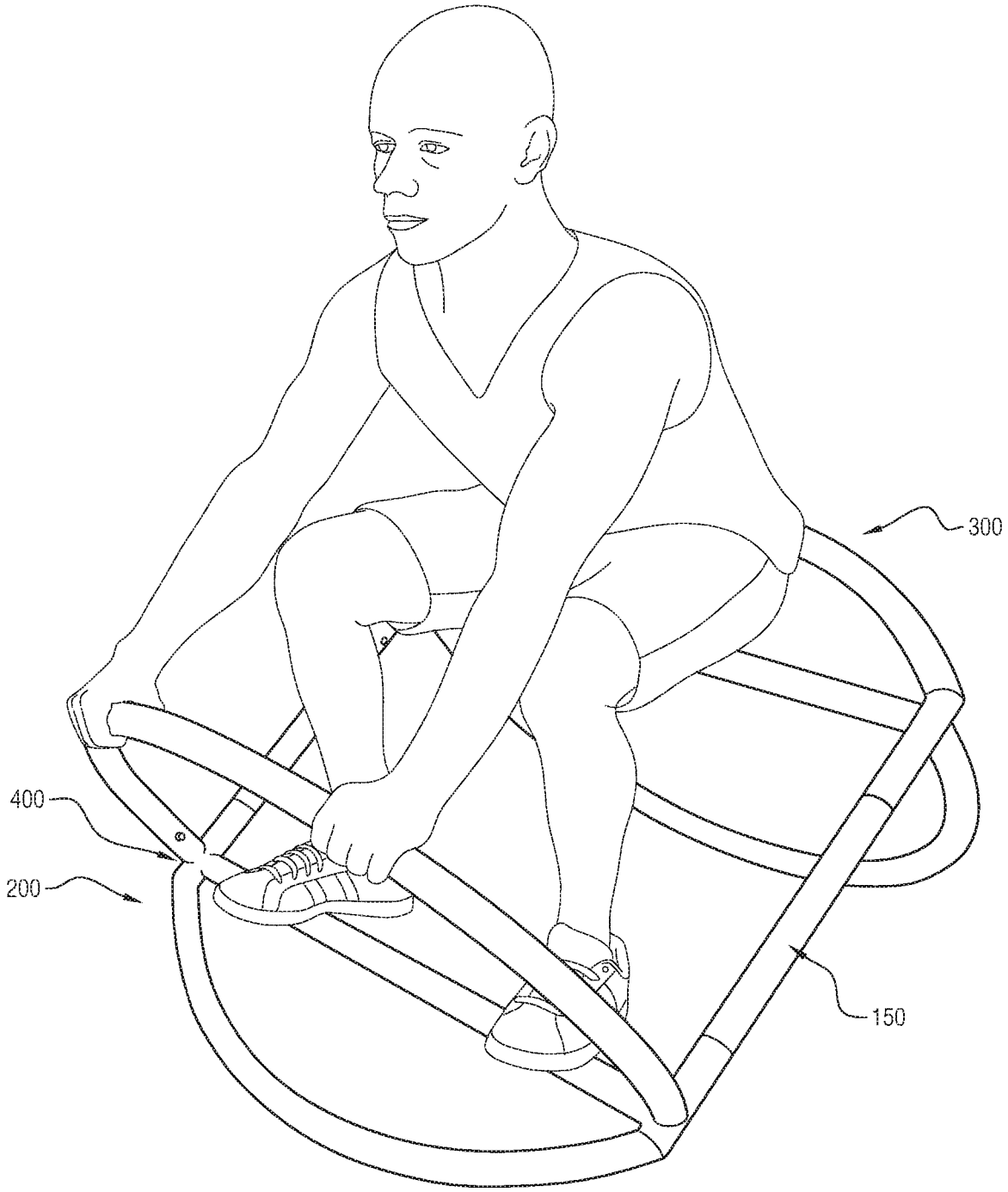
FIG. 9 is a perspective view of an embodiment of the present invention assembled in an opposing configuration.

In the opposing configuration, as shown in FIGS. 7-9, the top of each of the elements of the first module 200 are oriented upwardly (using FIG. 5 as a reference), and the top of each of the elements of the second module 300 are oriented downwardly (using FIG. 5 as a reference). The two longitudinal bars 150 may be oriented upwardly or downwardly.

In the opposing configuration of FIGS. 7-9, the versatile balance and exercise apparatus 100 is not symmetrical, so the user can practice balance training while working the muscles of the core, including abdominals, obliques, and lower back muscles. As the user balances on the uneven, asymmetrical exercise device, the core muscles are engaged and strengthened. The feet may be placed on the lateral cross bars 210, 310, as in FIG. 8, with a hand on the upwardly-projecting arched bar 230. Then the user may rock back and forth or do standing-types of exercises. As shown in FIG. 9, the user may sit on one of the lateral cross bars 210, 310 and may reach across to the upwardly-projecting arched bar 230. To remain in this position, the core muscles are used to counteract the natural movement of the unsteady, asymmetrical exercise device. Counterbalancing this movement engages a wide range of muscles.

As seen in FIGS. 10-14, a subset array of the complete array of bars forming the exercise and balance fitness apparatus is separable from the remaining elements of the fitness device and is usable as an exercise and balance fitness apparatus on its own. Though this subset array is shown throughout the figures as the single first module 200 in combination with the two longitudinal bars 150, this subset array may equally well be formed by the single second module 300 in combination with the two longitudinal bars 150. Using a subset configuration increases the number and variety of exercises that can be performed compared to only the corresponding and opposing configurations.

Figure 10:
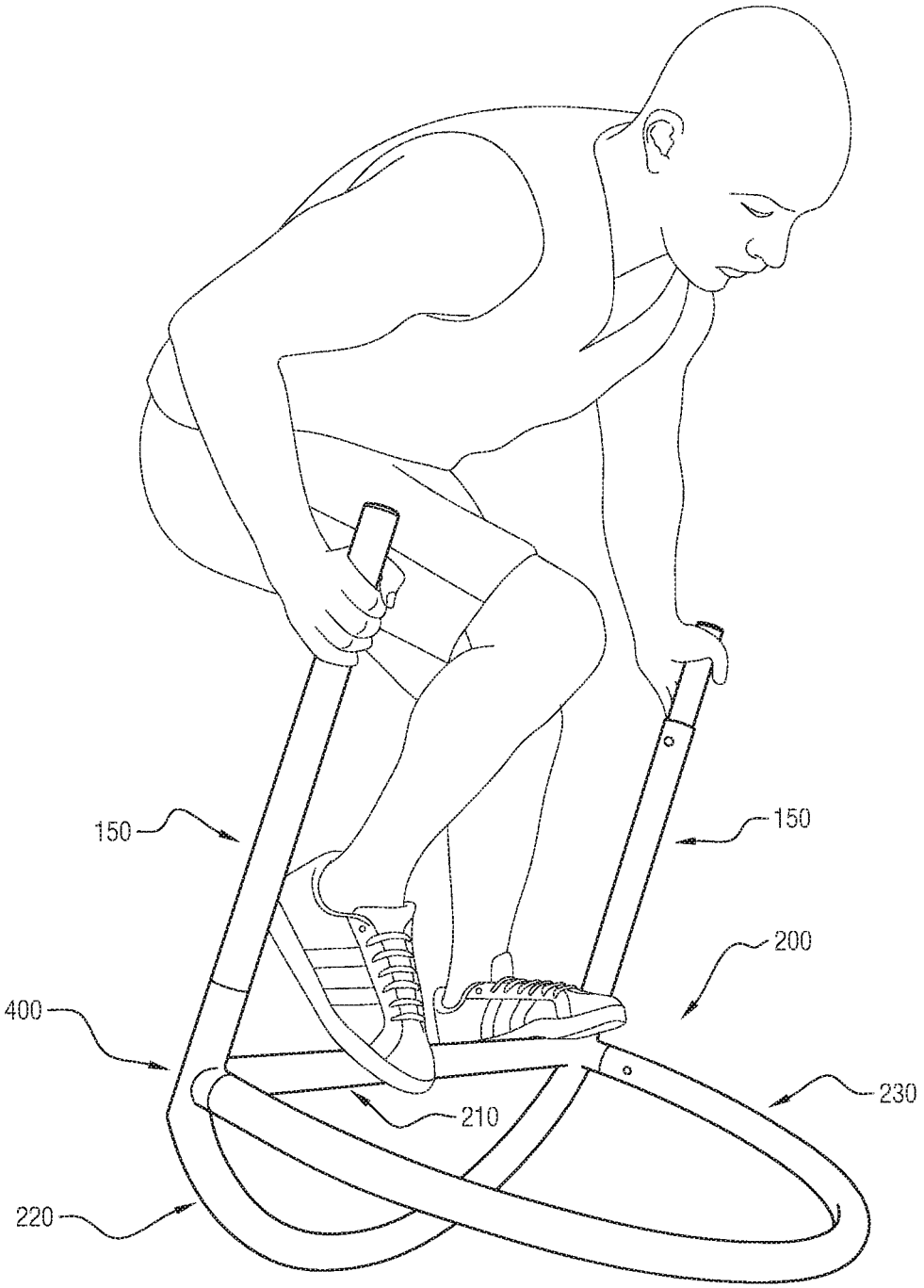
FIG. 10 is a perspective view of an embodiment of the present invention assembled in a rocking configuration using a subset array alone.

FIG. 10 illustrates the subset array with the partial circular bar 220 and arched bar 230 resting on the floor with the user holding onto the unattached end portions of the longitudinal bars 150. This orientation provides balance training due to the rocking motion that ensues as the weight of the user is redistributed. If the user prefers to be more upright, an extension 160 (FIG. 5) may be placed on each of the unattached end portions of the longitudinal bars 150.

Figure 11:
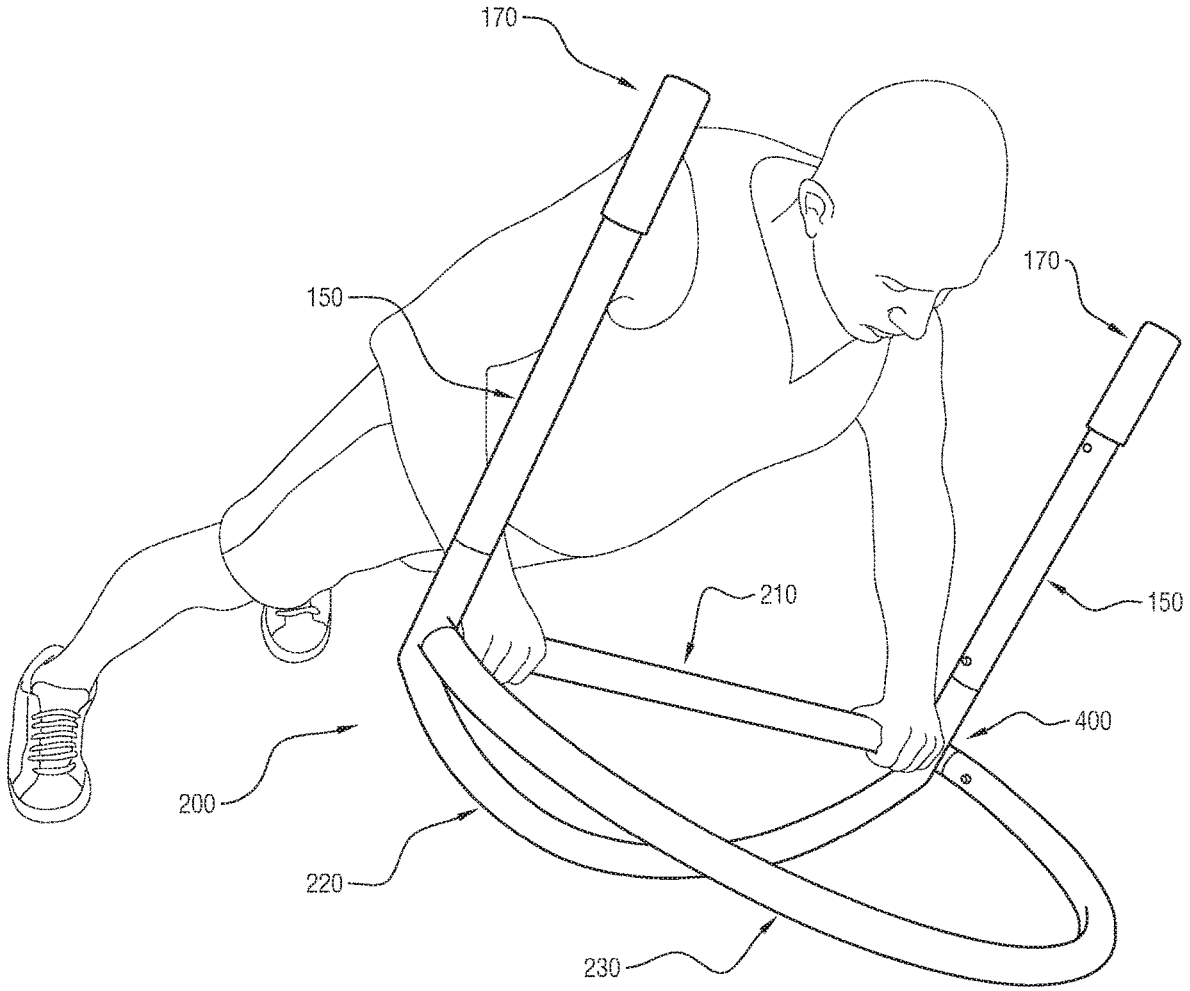
FIG. 11 is a perspective view of an embodiment of the present invention in a rocking configuration using a subset array alone.

FIG. 11 illustrates the subset array with safety protective caps 170 disposed on the exposed ends of the arched bars 230, 330. The protective caps 170 are cylinders with a closed end that are formed to fittingly engage with the exterior walls of the arched bars 230, 330. The protective caps 170 may be formed of a material that is smooth and solid, a slightly flexible material, or a material that has slip-resistant properties.

FIG. 11 also illustrates the rocking motion provided by the exercise apparatus when the subset array is positioned with the partial circular bar 220 and arched bar 230 resting on the floor with the user holding onto the lateral cross bar 210. This orientation provides balance training as well as core strengthening.

Figure 12:
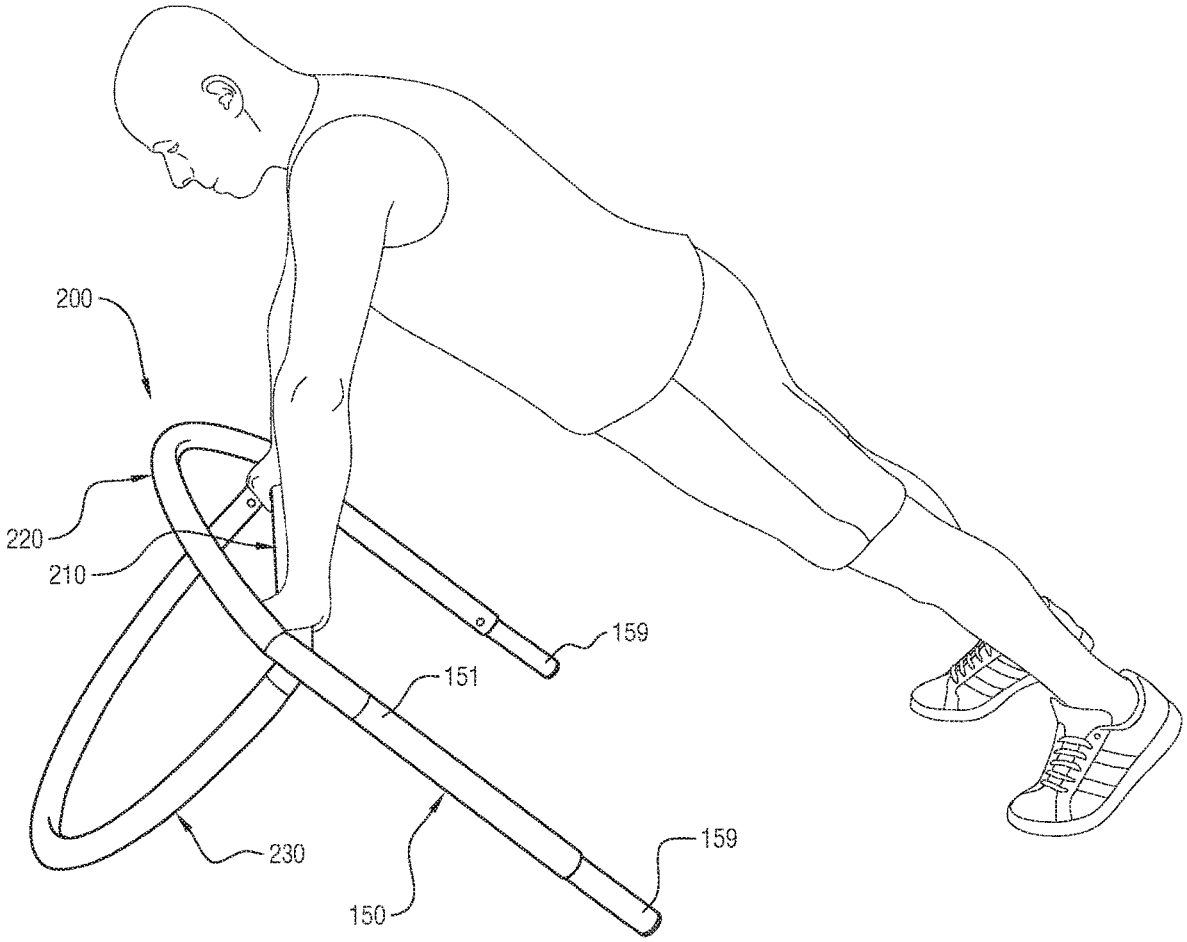
FIG. 12 is a perspective view of an embodiment of the present invention in a stable configuration using a subset array alone.
Figure 13:
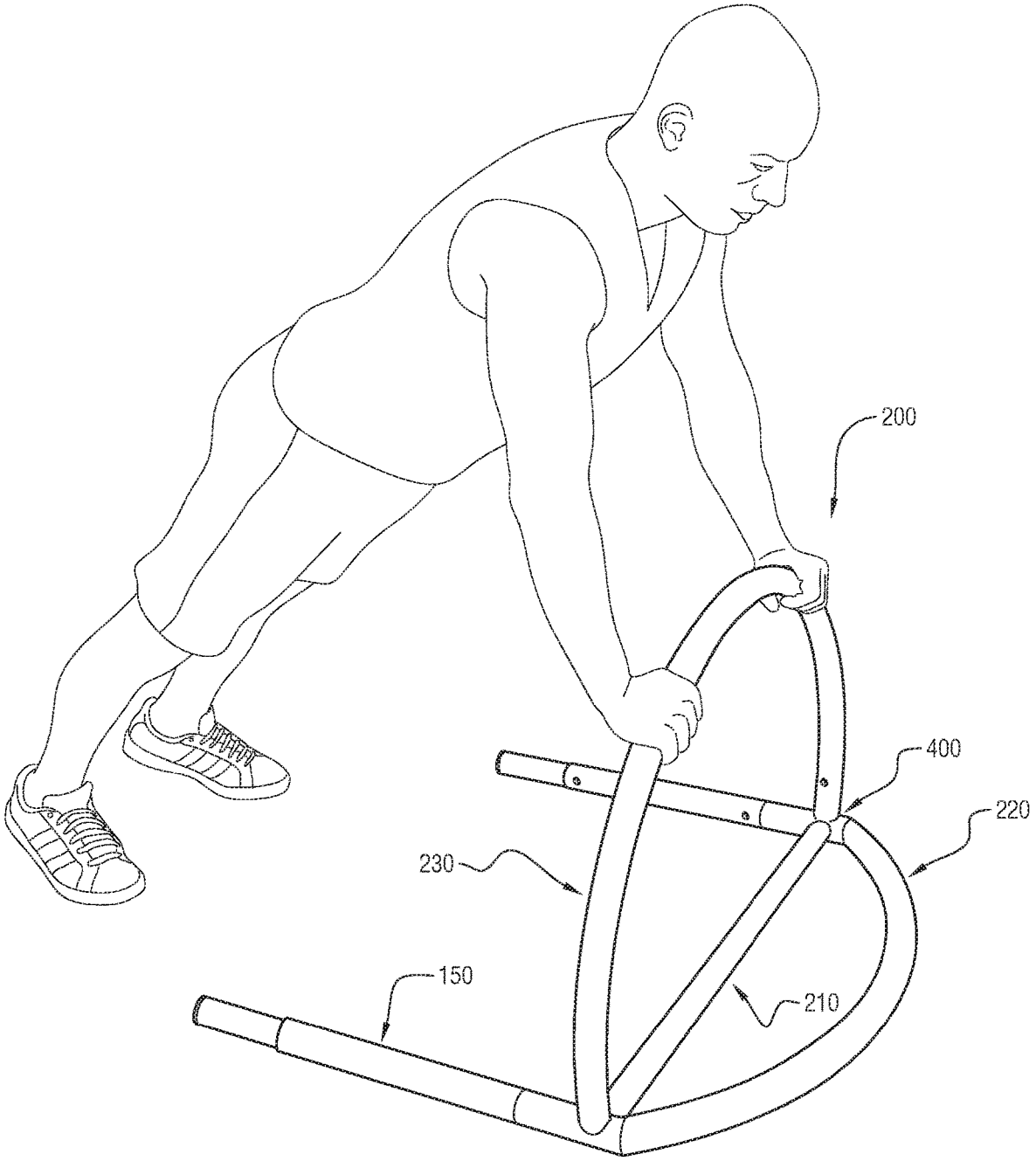
FIG. 13 is a perspective view of an embodiment of the present invention in a stable configuration using a subset array alone.
Figure 14:
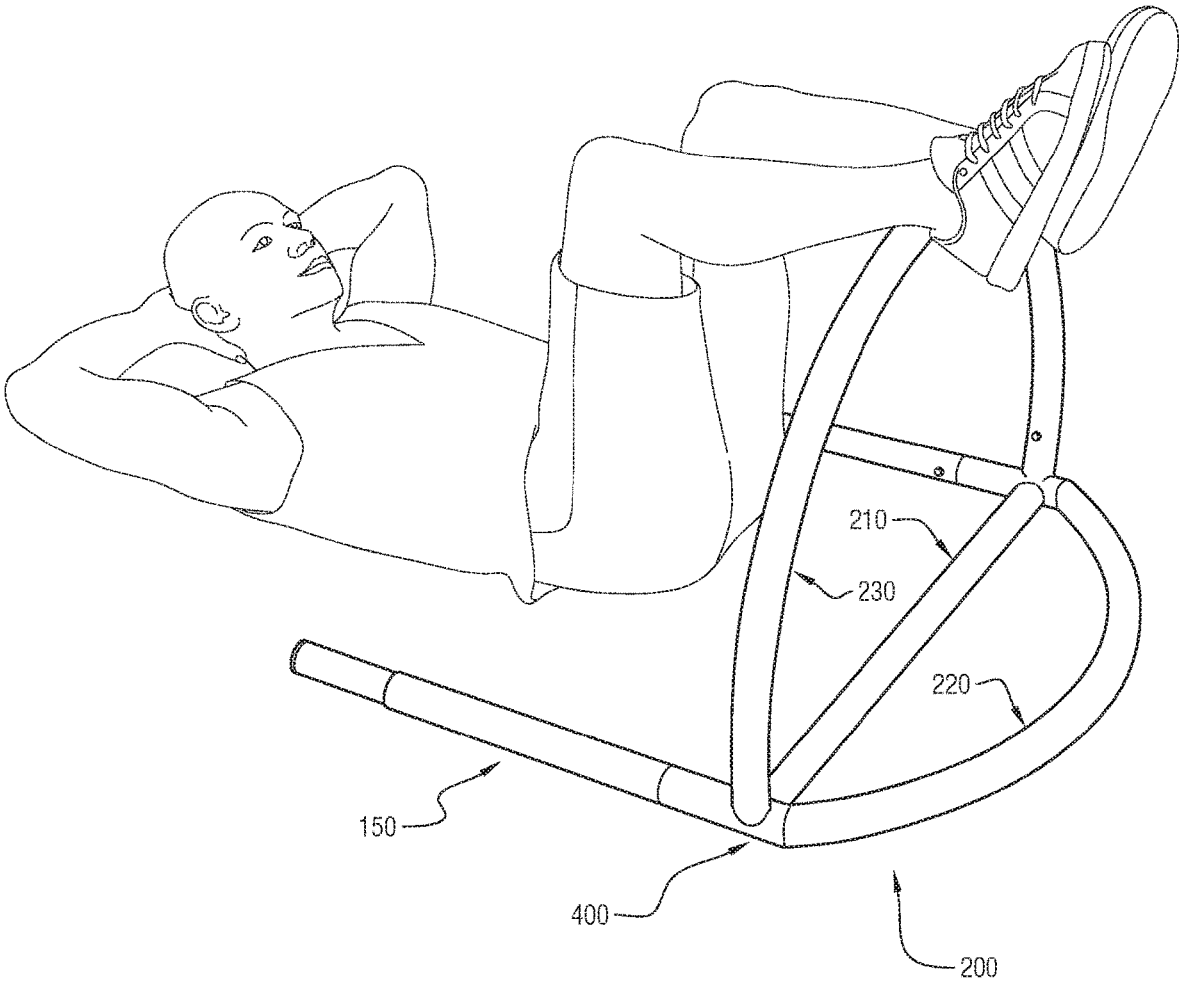
FIG. 14 is a perspective view of an embodiment of the present invention in a stable configuration using a subset array alone.

FIGS. 12-14 illustrate an orientation of the subset array that does not incorporate the rocking motion of FIGS. 8-11. FIG. 12 shows the subset array with the ends of the longitudinal bars 150 and the center of the arched bar 230 resting on the floor with the user gripping the lateral cross bar 210.

FIGS. 13-14 illustrate the subset array with the bottom of the longitudinal bars 150, a portion of the two joints 400, and the bottom of the partial circular bar 220 resting on the floor. The user may position his hands on the upwardly extending arched bar 230 (FIG. 13). This position allows for push-up type exercises when the user is facing forward and dip-type exercises when the user is facing backward.

As seen in FIG. 14, the user may alternatively position his feet on the upwardly-extending arched bar 230. In this position, the user may perform various sit-up type exercises, yoga move, stretches, and pelvic-lifting exercises.

As seen throughout the figures, both the first and second embodiments of the versatile balance and exercise apparatus 100 and the various apparatus orientations herein presented are usable to perform many different exercises for a variety of muscle groups and to practice balance training. With the separable modules of the second embodiment even a wider assortment of strengthening and balance exercises may be performed.

To use the versatile balance and exercise apparatus 100 in the corresponding orientation, the user positions the fitness apparatus 100 on the floor. The user may place one or both hands or one or both feet on one or both arched bars 230, 330. For example, when the user places his hands on the tops of the arched bars 230, 330, he may perform handstands or other chest and arm exercises. In another example, the user may place one hand on top of one of the arched bars 230, 330 and twist his body to stretch the obliques.

To use the versatile balance and exercise apparatus 100 in the opposing orientation, the user may position one of the arched bars 230 or 330 and one of the partial circular end bars 220 or 320 onto the floor to swing side to side for balance training. Either the feet (FIG. 8), the hands, the feet and posterior (FIG. 9), or other variations of body parts may be place on the central foundation base.

In the separable embodiment, the subset array may be created by detaching a single module when the versatile balance and exercise apparatus 100 is either in the corresponding orientation or in the opposing orientation. The user detaches the two longitudinal bars 150 from the two joints 400 to which they are attached. This is done by disengaging the movable locking mechanism that is disposed at the intersection of the joint 400 and the longitudinal bar 150. For example, as seen in FIG. 6, the depressible button 415 disposed at the intersection of the joint portion 411 may be depressed to release the joint portion 411 from the end 151 of the longitudinal bar 150. Then the other longitudinal bar 150 is disengaged in a similar manner. Other types of locking mechanisms, as are known in the art, may optionally be used.

Optionally, the user may attach an extension 160 to the unattached ends 151 of the longitudinal bars 150 to lengthen the longitudinal bars 150 to facilitate some types of exercises. Optionally, the user may then cover the unattached ends 151 (FIG. 5) of the longitudinal bars or the unattached ends 161 of the extensions 160 with protective covers 170 (FIG. 11). The subset array that has been created can be turned to lay flat in a stable position with the bottoms of the longitudinal bars 150 and the bottoms of the partial circular bars 220 or 230 against the floor, leaving the arched bar 230 or 330 extending upwardly to be used for exercises and stretches. Or the subset array can be oriented in a rocking position with the centers of the two curved portions resting against the floor. One or both hands or one or both feet can be engaged with the subset array to perform the variety of exercises.

Due to its relatively compact size and manageable weight, both the first and second embodiments of the versatile balance and exercise apparatus 100 are transportable. Particularly, the second embodiment provides advantages in storage and transport due to the ability to collapse at least a portion of the versatile balance and exercise apparatus 100 to create a smaller volume.

The versatile balance and exercise apparatus 100 is suitable for use in a home gym, in schools, in recreational facilities, in gymnastics training centers, in group classes in gyms, and the like. The number and types of exercises, stretches, and balance drills that can be performed is large compared to the storage space required. The fitness device 100 may be used by adults or by children.

In the embodiments of the versatile balance and exercise apparatus 100 the bars 210, 220, 230, 310, 320, 330, 150 may be tubular metal or may be formed of manmade materials including plastic-type materials that may be solid or have an inner open space. Preferably the bars 210, 220, 230, 310, 320, 330, 150 are cylindrical metal with an interior open space. However the bars 210, 220, 230, 310, 320, 330, 150 may not be cylindrical or only portions of them may be cylindrical. For example, the arched bars 230, 330 and partial circular bars 220, 320 may have a center curved section that transitions into a square end portion that connects to a corresponding square portion of the joint 400.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An exercise apparatus, comprising:

a central foundation frame comprising two generally parallel lateral cross bars, two generally parallel longitudinal bars, four 4-way joints, and two partial circular bars; wherein each of said two generally parallel lateral cross bars comprises a first straight middle portion extending between a first lateral cross bar end portion and a second lateral cross bar end portion; wherein said first lateral cross bar end portion and said second lateral cross bar end portion respectively attach to one of said four 4-way joints; wherein each of said two generally parallel longitudinal bars comprises a second straight middle portion extending between a first longitudinal bar end portion and a second longitudinal bar end portion; wherein said first longitudinal bar end portion and said second longitudinal bar end portion respectively attach to one of said four 4-way joints; wherein each of said two partial circular bars comprises a first curved middle portion extending between two partial circular bar end portions; wherein each of said two partial circular bar end portions respectively attaches to one of said four 4-way joints; and two arched bars including a second curved middle portion extending between two arch end portions; wherein each of said two arch end portions respectively attaches to one of said four 4-way joints; and wherein said four 4-way joints have three connection portions generally in a same first plane and have one connection portion in a second plane generally perpendicular to said same first plane.

2. The exercise apparatus as recited in claim 1, wherein:

a first one of said two generally parallel lateral cross bars, a first one of said two partial circular bars, a first one of said two arched bars, and a first and second one of said four 4-way joints comprise a first module;

a second one of said two generally parallel lateral cross bars, a second one of said two partial circular bars, a second one of said two arched bars, and a third and fourth one of said four 4-way joints comprise a second module; and said first module is attached to said second module by said two generally parallel longitudinal bars.

3. The exercise apparatus as recited in claim 2, wherein said first module and said second module are fixedly attached to said four 4-way joints.

4. The exercise apparatus as recited in claim 2, wherein said first module and said second module are oriented in a corresponding configuration in which said first one of said two arched bars is oriented in a first direction from said central foundation frame and with said second one of said two arched bars also oriented in said first direction from said central foundation frame.

5. The exercise apparatus as recited in claim 1, further comprising a slip-resistant material disposed on at least a top of said two arched bars.

6. The exercise apparatus as recited in claim 1, further comprising at least four feet disposed on a bottom of said central foundation frame.

7. The exercise apparatus as recited in claim 1, wherein said two arched bars are respectively detachable from said four 4-way joints.

8. The exercise apparatus as recited in claim 1, wherein said two generally parallel longitudinal bars are respectively detachable from said four 4-way joints.

9. An exercise apparatus, comprising:

a generally planar central foundation frame comprising two generally parallel lateral cross bars, two generally parallel longitudinal bars, four 4-way joints, and two partial circular bars; and two arched bars including a first curved middle portion extending between two arch end portions; wherein:

each of said two arch end portions respectively attaches to one of said four 4-way joints;

each of said two generally parallel lateral cross bars comprises a first straight middle portion extending between a first lateral cross bar end portion and a second lateral cross bar end portion;

said first lateral cross bar end portion and said second lateral cross bar end portion respectively attach to one of said four 4-way joints;

each of said two generally parallel longitudinal bars comprises a second straight middle portion extending between a first longitudinal bar end portion and a second longitudinal bar end portion;

said first longitudinal bar end portion and said second longitudinal bar end portion respectively attach to one of said four 4-way joints;

each of said two partial circular bars comprises a second curved middle portion extending between two partial circular bar end portions;

each of said two partial circular bar end portions respectively attaches to one of said four 4-way joints;

said four 4-way joints have three openings generally in a same first plane and have one opening in a second plane generally perpendicular to said same first plane;

a first one of said two generally parallel lateral cross bars, a first one of said two partial circular bars, a first one of said two arched bars, and a first and second one of said four 4-way joints comprise a first module;

a second one of said two generally parallel lateral cross bars, a second one of said two partial circular bars, a second one of said two arched bars, and a third and fourth one of said four 4-way joints comprise a second module; and said first module is attached to said second module by said two generally parallel longitudinal bars.

10. The exercise apparatus as recited in claim 9, wherein said two generally parallel lateral cross bars, said two partial circular bars, said two arched bars, and said two generally parallel longitudinal bars are fixedly attached to said four 4-way joints.

11. The exercise apparatus as recited in claim 9, wherein said first module and said second module are oriented in a corresponding configuration in which said first one of said two arched bars is oriented in a first direction from said generally planar central foundation frame and with said second one of said two arched bars also oriented in said first direction from said generally planar central foundation frame.

12. The exercise apparatus as recited in claim 9, wherein said two arched bars are respectively detachable from said four 4-way joints.

13. The exercise apparatus as recited in claim 9 wherein said two generally parallel longitudinal bars are respectively detachable from said four 4-way joints.

* * * * *